US006823906B2

(12) United States Patent
Hord, III et al.

(10) Patent No.: US 6,823,906 B2
(45) Date of Patent: Nov. 30, 2004

(54) ACETYLENE DISTRIBUTION SYSTEM

(75) Inventors: W. Dan Hord, III, Bellville, TX (US); Ted M. Royer, Orange, TX (US); Brian H. Schumann, Bellville, TX (US); Donald F. Constantine, Conroe, TX (US); Craig A. Robertson, Bellville, TX (US); Joseph Burghard, Bellville, TX (US)

(73) Assignee: Western International Gas & Cylinder Inc., Bellville, TX (US)

( * ) Notice: Subject to any disclaimer, the term of this patent is extended or adjusted under 35 U.S.C. 154(b) by 0 days.

(21) Appl. No.: 10/641,204

(22) Filed: Aug. 14, 2003

(65) Prior Publication Data

US 2004/0031537 A1 Feb. 19, 2004

Related U.S. Application Data

(60) Provisional application No. 60/404,028, filed on Aug. 16, 2002.

(51) Int. Cl.[7] ..... B65B 1/04

(52) U.S. Cl. ..... 141/231; 141/83; 141/192

(58) Field of Search ..... 141/2, 18, 83, 141/231, 192, 197, 9, 100–104

(56) References Cited

U.S. PATENT DOCUMENTS

| | | | | | |
|---|---|---|---|---|---|
| 4,582,100 | A | * | 4/1986 | Poulsen | 141/4 |
| 4,784,399 | A | | 11/1988 | Finn | 280/5 |
| 5,040,933 | A | | 8/1991 | Lee et al. | 410/42 |
| 5,921,291 | A | * | 7/1999 | Hord et al. | 141/82 |
| 6,182,713 | B1 | * | 2/2001 | Deck et al. | 141/18 |
| 6,339,996 | B1 | | 1/2002 | Campbell | 114/74 |
| 6,655,422 | B2 | * | 12/2003 | Shock | 141/83 |

* cited by examiner

*Primary Examiner*—Stephen O. Douglas
(74) *Attorney, Agent, or Firm*—Moser, Patterson & Sheridan

(57) ABSTRACT

The present invention generally an apparatus and a method for filling tanks with acetylene gas. The invention includes filling a first tank to a first level, thereafter filling a second tank while continuing to fill the first tank. The invention further includes restricting the flow of gas to the second tank while continuing to fill the first tank. The invention also includes a first and a second transportable source of compressed acetylene.

15 Claims, 7 Drawing Sheets

ACETYLENE DISTRIBUTION SYSTEM

CROSS-REFERENCE TO RELATED APPLICATIONS

This application claims benefit of U.S. provisional patent application Ser. No. 60/404,028, filed Aug. 16, 2002, which is herein incorporated by reference.

BACKGROUND OF THE INVENTION

1. Field of the Invention

The present invention relates to a method and an apparatus for supplying compressed gas to a point of use. More particularly, the invention relates to an acetylene distribution system that fills a transportable source of gas that can be located at a worksite, used and then removed and replaced by another transportable source.

2. Description of the Related Art

Compressed fuel gases, especially gases such as acetylene, are well known and widely used in construction and manufacturing. Typically, acetylene is mixed with oxygen at a point of use to provide a combustible mixture. Because of its volatility, acetylene must be carefully handled before and during use. Conventionally, acetylene is provided at a point of use in a cylinder that can be delivered and then removed and refilled.

In addition to simple welding operations requiring a single cylinder, there are many operations that make use of large amounts of acetylene, making the use of a single cylinder at a time impractical. In these instances, several cylinders can be used in combination with a manifold to provide a constant source of acetylene to an operation. In one prior art arrangement, cylinders are delivered to the worksite connected together with a manifold and, with the use of equipment to regulate pressure, used to provide regulated acetylene to an operation. More recently, cylinders have been arranged on a trailer and then used at a site while remaining on the trailer. This approach eliminates the unloading and reloading of the cylinders at the point of use, and consequently makes it easier to replace empty cylinders with filled cylinders.

Typically, the trailer is taken to an acetylene supply plant to fill the cylinders with acetylene. The acetylene plant consists of a trailer filling system that connects to the manifold on the trailer to facilitate the filling of the cylinders. In a conventional filling system, multiple trailers are filled simultaneously. However, due to the chemical characteristics of acetylene, the filling process slows down as trailers get close to being filled. Specifically, acetylene cylinders accept gas at a progressively lower rate due to exothermic heat buildup increasing partial pressures of the acetylene/solvent mix within the cylinder. Therefore, in conventional filling systems, the typical approach is to fill trailers in parallel and then let them cool, often overnight, and subsequently finish the filling process the following morning. Thereafter, a few cylinders are removed from the trailer, weighed, and the total weight for the trailer is extrapolated. This intermittent filling procedure is non-conducive to acetylene suppliers that typically make and supply acetylene on a continuous round-the-clock basis.

After the cylinders are filled with acetylene, the trailer transports the acetylene to a worksite requiring acetylene gas. Pressure regulating equipment is connected to the trailer to discharge the acetylene from the cylinders. The pressure regulating equipment is typically secured in one location, thereby limiting the supply of acetylene to one specific area of the worksite. Therefore, if acetylene is required at another location, the acetylene gas is transported through an extensive piping arrangement. The use of pipes to transport acetylene to a new location on a worksite can be very costly and creates delays due to piping construction time along with safety concerns due to the volatility of acetylene.

There is a need, therefore, for a method to safely and economically fill acetylene into cylinders on a trailer. There is a further need to safely and economically transport acetylene to a worksite. There is yet a further need for a transportable acetylene distribution apparatus that provides a simple and flexible way to provide and use large volumes of compressed acetylene at a worksite.

SUMMARY OF THE INVENTION

The present invention generally relates to an apparatus and a method for filling tanks with acetylene gas. In one aspect, a method for filling tanks with acetylene gas is proved. The method includes filling a first tank to a first level, thereafter filling a second tank while continuing to fill the first tank. The method further includes restricting the flow of gas to the second tank while continuing to fill the first tank. The method also includes a first and a second transportable source of compressed acetylene.

In another aspect, a transportable acetylene distribution apparatus is provided. The acetylene distribution apparatus includes a piping system to act as a fluid conduit for the distribution of acetylene and at least one valve connected to the piping system, whereby the at least one valve controls the flow of acetylene. The acetylene distribution apparatus further includes at least one pressure regulating member connected to the piping system and at least one connector attached to the piping system. The acetylene distribution apparatus also includes a platform, whereby the piping system is disposed on the platform.

In yet another aspect, a method for filling cylinders on a trailer system with acetylene gas is provided. The method includes transporting acetylene gas to a trailer fill plant and compressing the acetylene gas by a plurality of compressors. The method also includes moving the compressed acetylene gas through the compressed gas supply line into the piping arrangement. The method further includes placing each trailer assembly into an individual fill bay and subsequently filling the cylinders on the trailer assemblies with acetylene gas.

BRIEF DESCRIPTION OF THE DRAWINGS

So that the manner in which the above recited features, advantages, and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
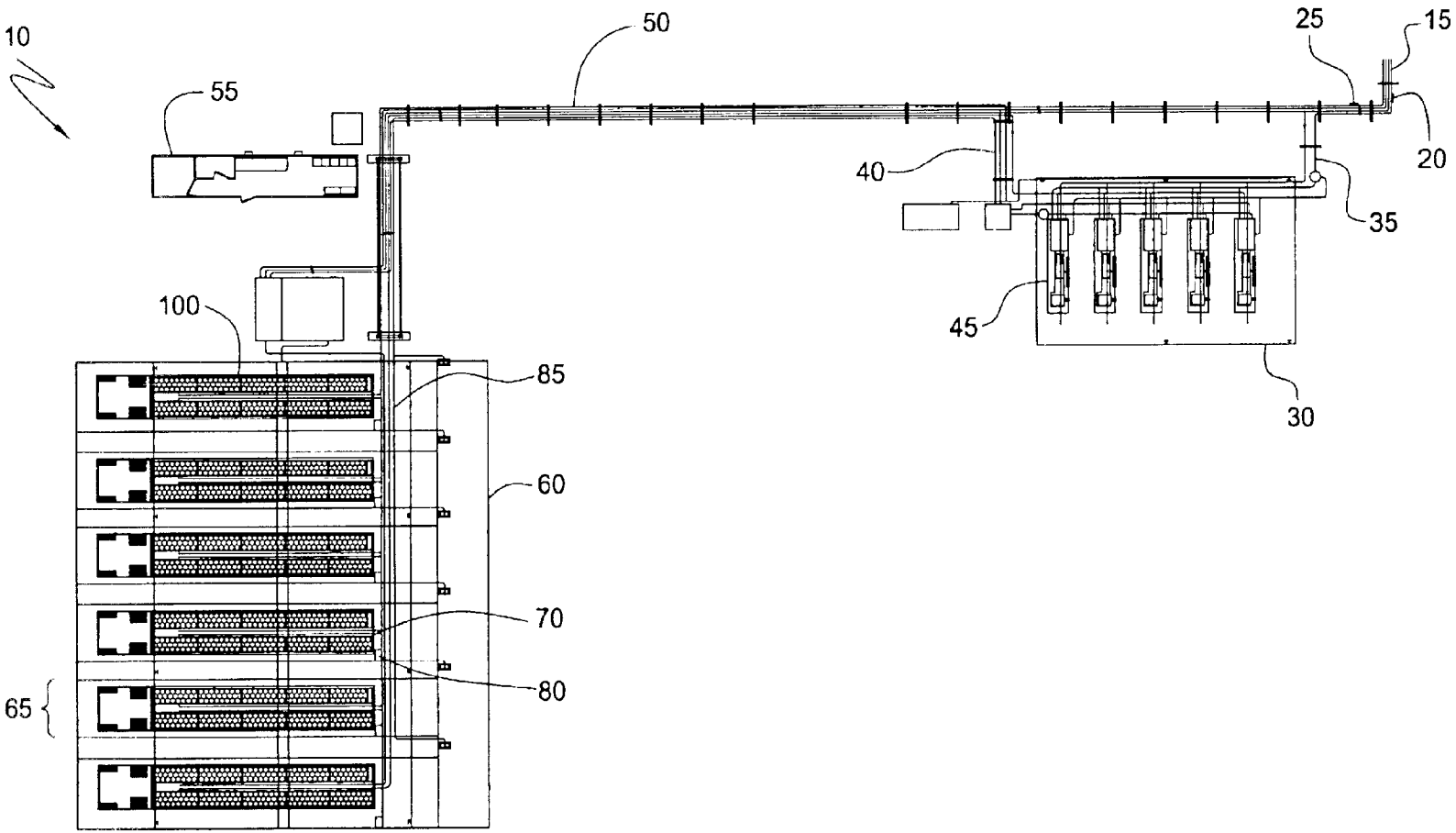
FIG. 1 illustrates a plan view of a trailer fill plant of an acetylene distribution system.

The present invention relates to an acetylene distribution system for safely filling, transporting, and providing acetylene gas to a worksite. The acetylene distribution system includes a trailer filling system 10, one embodiment of which is shown in a plan view in FIG. 1. The trailer filling system 10 is controlled by a motor control center 55. Typically, the motor control center 55 is monitored by an offsite supervisory control and data acquisition system.

Generally, low-pressure acetylene enters into the trailer fill plant 10 through a gas pipeline 15. The amount of acetylene that flows through the pipeline 15 is measured on a metallic device. Additionally, a flash arrestor 25 is placed on the gas pipeline 15 as a safety device to stop an acetylene flash. Thereafter, the acetylene from the gas pipeline 15 enters into a plurality of compressor input lines 35 to transport the acetylene into several compressors 45 housed in a compressor building 30. The acetylene typically enters the compressors 45 at 6–8 PSIG and is subsequently compressed to about 360 PSIG. Next, the compressed acetylene exits the compressor building 30 through a plurality of compressor output lines 40. Thereafter, the compressed acetylene flows into a compressed gas pipeline 50.

As shown in FIG. 1, the compressed gas pipeline 50 is connected to a fill building 60. The fill building 60 comprises of a plurality of fill bays 65, each of which is sized to accommodate a trailer assembly 100. Each fill bay 65 includes a scale 70 and a computer 80 to monitor the acetylene entering the bay 65. The computer 80 is configured to receive signals from the scale 70 to monitor the amount of acetylene entering the fill bay 65. Additionally, the fill bays 65 are interconnected with each other through an acetylene supply pipe and control valve system 85. The supply pipe and control valve system 85 are connected to the compressed gas pipeline 50, thereby enabling compressed acetylene to enter each individual fill bay 65. The supply pipe and control valve system 85 may be constructed and arranged in a cascading manner to allow flow controlling to each fill bay 65.

The trailer filling system 10 is designed to safely and efficiently fill cylinders on the trailer assembly 100 with acetylene. Typically, each of the fill bays 65 contains the trailer assembly 100 in some stage of the filling process. As the trailer assembly 100 becomes full, the trailer assembly 100 is removed and replaced with an empty trailer assembly 100. After an empty trailer assembly 100 enters the fill bay 65, the operator inputs data, such as trailer origination and trailer identification, into the computer 80 and connects the empty trailer assembly 100 to the acetylene supply pipe in the fill bay 65. Thereafter, the empty trailer assembly 100 is automatically placed into the fill queue as the last one to be filled.

The control valve system 85 receives a predefined constant flow rate from the gas pipeline 50 and subsequently distributes the gas to the plurality of fill bays 65. The control valve system 85 controls the amount of acetylene entering each bay 65 by monitoring the weight of the trailer assembly 100 during the filling process. The control valve system 85 operates in a flow control manner to allow the trailer assembly 100 with the greatest amount of acetylene to receive the largest flow of acetylene from the compressed gas pipeline 50. As the trailer assembly 100 becomes close to being filled with acetylene, the trailer assembly 100 will accept acetylene at a progressively lower rate due to exothermic heat buildup in each cylinder and rising overall partial pressures of the acetylene/acetone mix. Therefore, as one trailer assembly 100 begins to take less acetylene gas, the next trailer assembly 100 begins to receive more, thereby permitting the total volume through the trailer filling system 10 to remain constant. In this respect, control valve system 85 forces or base loads the acetylene into the trailer assembly 100 with the largest amount of acetylene and swing loads the remaining molecules into the less full trailer assemblies 100. The scale 70 sends periodic signals to the computer 80, thereby monitoring the weight of each trailer assembly 100 during the filling process to determine when the trailer assembly 100 is full of acetylene. Thereafter, the full trailer assembly 100 is taken off the supply pipe and the next trailer assembly 100 in line becomes based loaded with acetylene with no change in the overall flow rate of the trailer filling system 10.

The acetylene distribution system further includes a transportable source of compressed acetylene. In one embodiment, the transportable source of compressed acetylene is the trailer assembly 100. It should be understood that this invention is not limited to this embodiment, but rather the transportable source of compressed acetylene can be ship-based, truck mounted, railcar mounted, or modular for container transportation.

Figure 2:
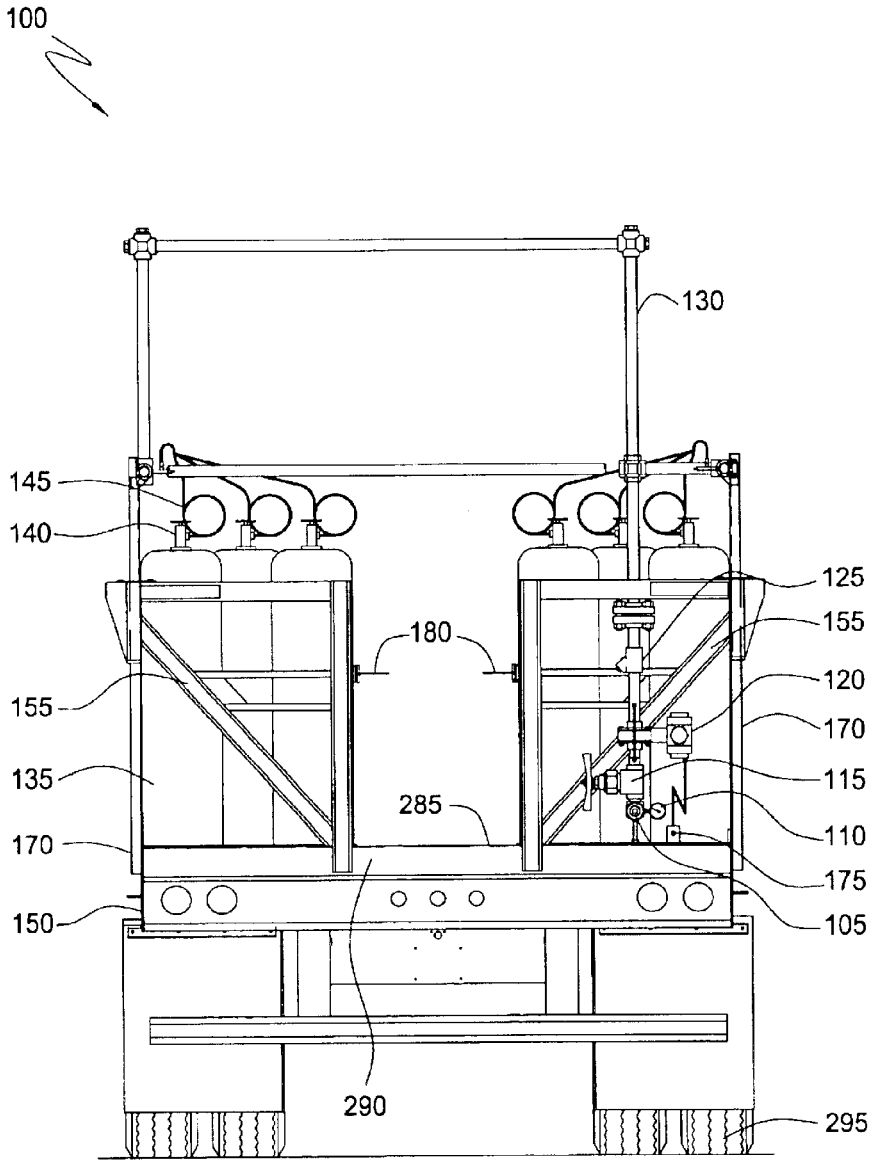
FIG. 2 illustrates a back view of a trailer assembly in accordance with the present invention.

FIG. 2 illustrates a back view of the trailer assembly 100 in accordance with the present invention. In the embodiment shown, the trailer assembly 100 includes a trailer 150 and a coupling (not shown) for attaching to a motorized vehicle. In one embodiment, the trailer 150 comprises a bed frame 290 to act as a support member and a plurality of wheels 295 for movement of the trailer assembly 100. The trailer assembly 100 further includes a connector 105 to connect the trailer assembly 100 directly to a point of use or to a pressure-regulating device (not shown). Attached to the connector 105 is a gauge 110 to indicate the pressure of the acetylene in the trailer assembly 100. A manual valve 115 is located above the connector 105 to control the flow of acetylene exiting the trailer assembly 100.

As shown in FIG. 2, a safety control valve 120 is located at the upper end of the manual valve 115. The safety control valve 120 works in conjunction with a safety control feed line 175 to provide an automatic shutdown during unsafe conditions. Typically, a hose (not shown) is connected between a pressure regulating apparatus (not shown) and the safety control feed line 175 on the trailer assembly 100. The safety control feed line 175 acts as an indication device to signal the safety control valve 120 about an unsafe condition that requires the shut down of the unloading process. For example, if the trailer assembly 100 pulls away from the pressure regulating apparatus during the unloading process, the hose will disengage from the safety control feed line 175 causing the safety control valve 120 to close, thereby shutting down the unloading process. In this manner, the safety control valve 120 controls the "breakaway" flow, thereby ensuring the safety of the unloading process of the acetylene distribution system.

The trailer assembly 100 further includes a strainer 125 disposed at the upper end of the safety control valve 120. The strainer 125 acts as a filtering means to prevent any contaminants in the trailer assembly 100 from entering valves 115, 120. A manifold system 130 is connected to the strainer 125. The manifold system 130 includes a plurality of pipes and acts as a distribution conduit for the acetylene. The manifold system 130 interconnects a plurality of cylinders 135 that house acetylene under pressure. The cylinders 135 are constructed and arranged to hold a predetermined quantity of compressed acetylene. At the upper end of each cylinder 135 is a cylinder valve 140 to control the flow of acetylene entering and exiting the cylinder 135. Attached to the upper end of each cylinder valve 140 is a high-pressure tubular loop (pigtail) 145 that acts as a fluid conduit between the cylinder 135 and the manifold system 130. The tubular loop 145 is constructed to be a flexible connection between the cylinder 135 and the manifold system 130, thereby minimizing the possibility of tubing failure during transport of the compressed acetylene.

Figure 3:
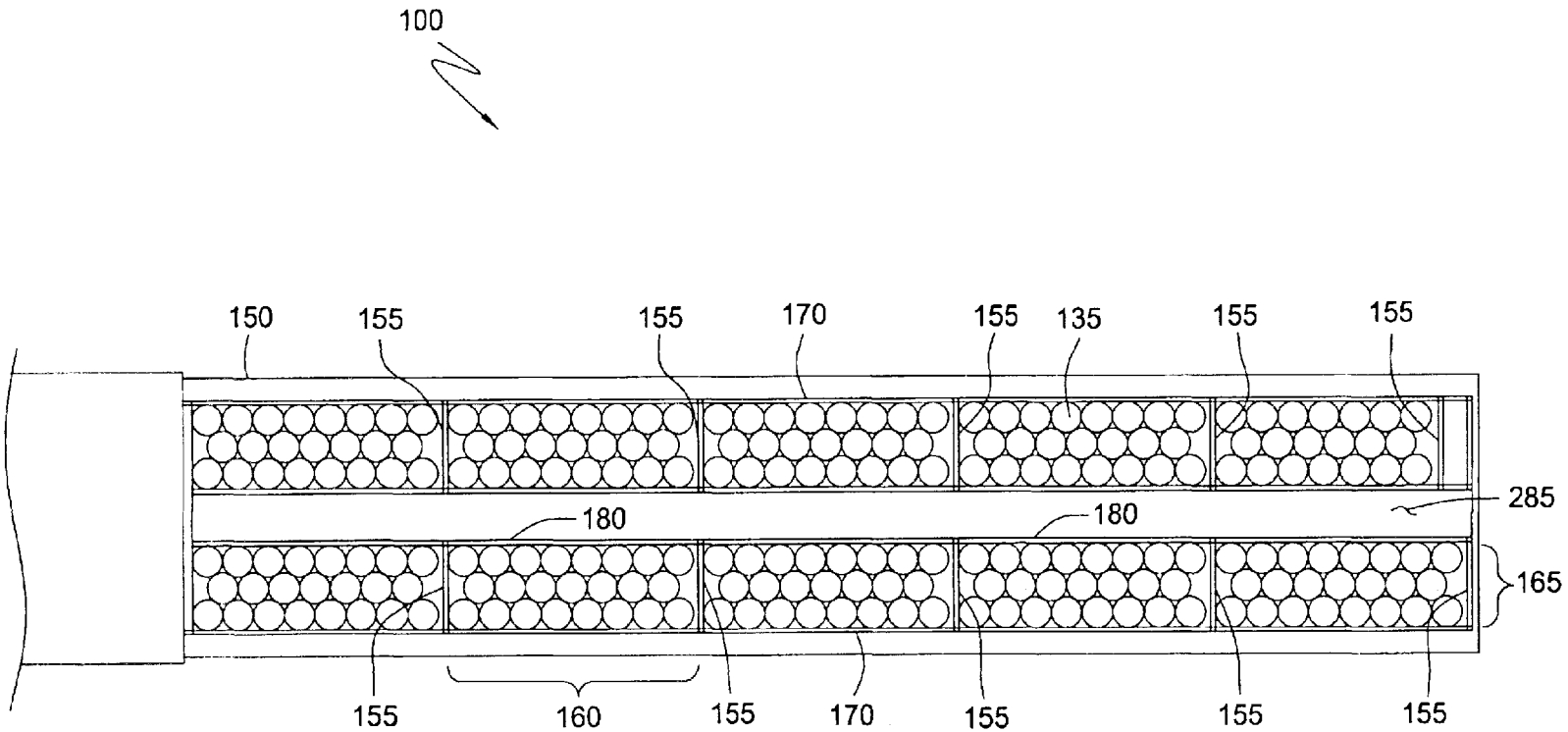
FIG. 3 illustrates a top view of the trailer assembly as shown in FIG. 2.

FIG. 3 illustrates a top view of the trailer assembly 100 as shown in FIG. 2. The trailer 150 is constructed and arranged to handle the plurality of cylinders 135 of compressed acetylene for transport from one point to another in a safe and efficient manner. Transportation regulations govern the weight of a trailer system. The trailer 150 of this embodiment is constructed without the standard center beams, thereby reducing the weight of the trailer 150 and allowing a larger quantity of cylinders 135 to be transported within weight regulations. In the embodiment shown, the trailer 150 is constructed of sidewall structural support members 170 that form a truss which replaces the center beams and distributes the weight of the cylinders 135 over the center axis portion of the trailer 150. As further shown, a plurality of support members 155 are connected to the sidewall support members 170 and the bed frame 290 to aid in the distribution of the load. Additionally, the length of the trailer 150 may be constructed to allow the maximum quantity of cylinders 135 to be transported within transportation regulations.

As shown, the cylinders 135 are nested in a plurality of sections 160 (illustratively shown) and a plurality of rows 165 (illustratively shown). Each section 160 is arranged to maximize the quantity of cylinders 135 within a predetermined space and to distribute the weight of the cylinders 135 over the outside edges of the trailer 150. The sections 160 are divided by the plurality support members 155 to secure the cylinders 135 within the section 160 during transport. In addition, the sidewall support members 170 on the outer edges and walkway members 180 form the rows 165. The members 170, 180 secure the cylinders 135 within the row 165 during transport. As further depicted, a walkway 285 is located along the center of the bed frame 290 to ensure easy access to cylinders 135.

Figure 4:
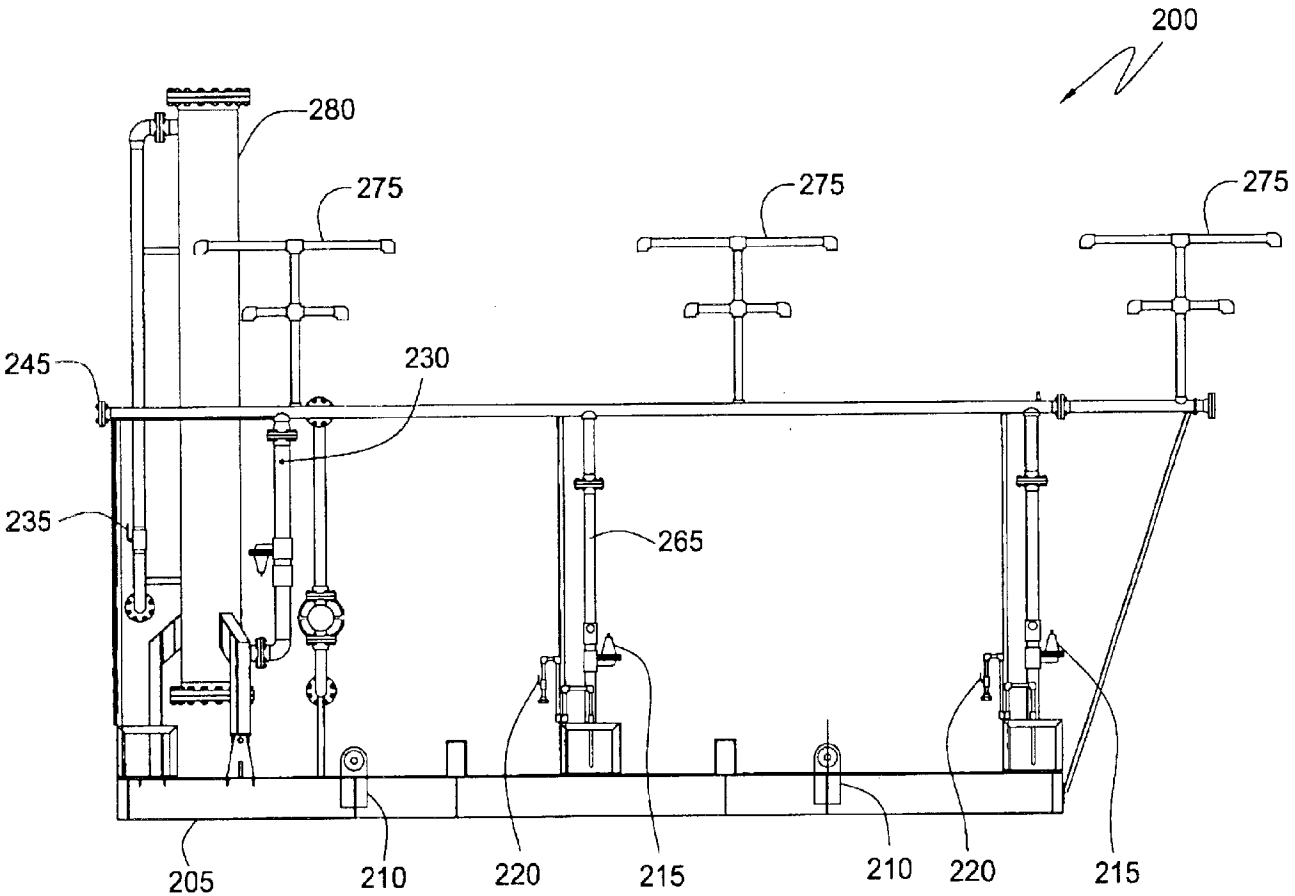
FIG. 4 illustrates a front view of one embodiment of a skid-mounted gas regulating apparatus in accordance with the present invention.

The acetylene distribution system further includes transportable gas regulating apparatus 200 to regulate the acetylene during the unloading process from the trailer assembly 100. FIG. 4 illustrates a front view of one embodiment of the skid-mounted gas regulating apparatus 200 in accordance with the present invention. The apparatus 200 is used to reduce the pressure of the acetylene and act as a conduit between the trailer assembly 100 and the point of use on the worksite. The apparatus 200 includes a platform 205 to provide support for the components of the apparatus 200. The platform 205 also permits the apparatus 200 to be moved as a complete unit from one point to another. A plurality of lugs 210 is connected to the platform 200 to aid in the movement of the apparatus 200. Typically, chains with hooks are connected to the lugs 210 allowing the apparatus 200 to be lifted by mechanical equipment and moved from one point to another. In this respect, the transportable gas regulating apparatus 200 is a portable regulating device for the acetylene distribution system.

As illustrated in FIG. 4, the apparatus 200 includes a ball valve 235 and a gate valve (not shown). A pressure switch 230 and a regulator 215 are located at the front portion of the apparatus 200. As shown, an arm 220 is disposed near the regulator 215. The arm 220 is extendable to connect to the trailer assembly 100 during the unloading process. As further shown, a plurality of interconnected pipes 265 are used to transport the acetylene throughout the apparatus 200. The pipes 265 connect to a header 245 and a flash arrestor 280 as shown. All the components are securely fastened to the platform 205, thereby allowing the apparatus 200 to act as one transportable unit.

In another embodiment, the trailer assembly 100 can be connected directly to the point of use through a regulator (not shown). In this embodiment, the apparatus 200 is not required to unload the acetylene gas. This embodiment is useful when the point of use requires only a single unit of compressed acetylene.

Figure 5:
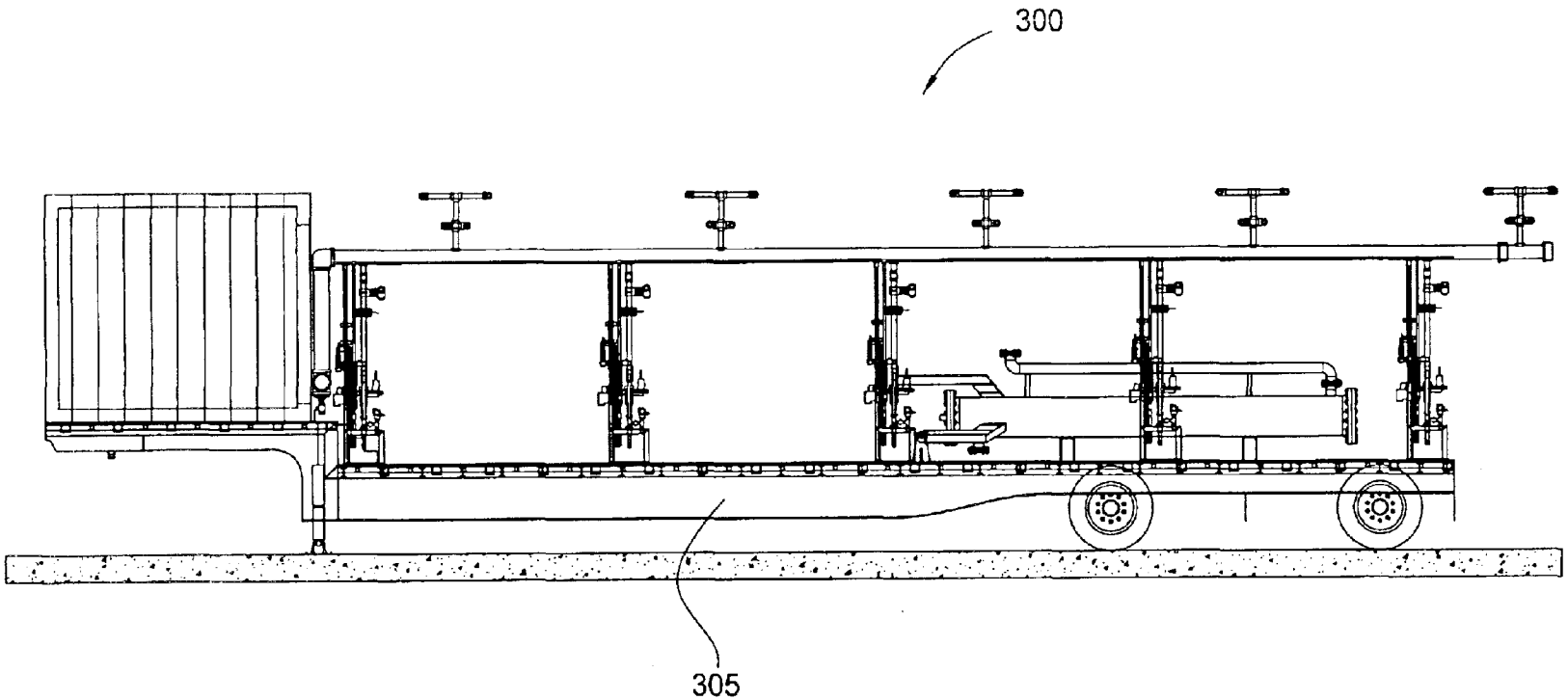
FIG. 5 illustrates another embodiment of a gas regulating apparatus in accordance with this present invention.

FIG. 5 illustrates another embodiment of a transportable gas regulating apparatus 300 in accordance with this present invention. The transportable gas regulating apparatus 300 contains similar components as the transportable gas regulating apparatus 200 shown in FIG. 4. In a similar manner to the apparatus 200, the apparatus 300 is used to reduce the pressure of the acetylene and act as a conduit between the trailer assembly 100 and the point of use. However, the principle difference between apparatus 200 and apparatus 300 is that apparatus 300 is permanently mounted on a trailer 305. The trailer 305 permits the apparatus 300 to be transported down the highway and throughout the worksite by a truck (not shown), thereby increasing mobility of the apparatus 300.

In operation, the trailer assembly 100 is brought to a predetermined location to fill the cylinders 135 as discussed in FIG. 1. In the preferred embodiment, the transportable source of compressed acetylene is the trailer assembly 100 as illustrated in FIGS. 2 and 3. After the cylinders 135 are filled with compressed acetylene, the trailer assembly 100 is taken to a point of use at the worksite. The point of use can be a manufacturing process, a reservoir for storage, a point of consumption, gas transport infrastructure, or any other location that requires compressed acetylene. In the preferred embodiment, the transportable gas regulating apparatus 200 or the trailer mounted apparatus 300 is located at a predetermined location at the worksite to act as a fluid conduit between the trailer assembly 100 and the point of use. The apparatus 200, 300 is connected at one end to the point of use and the other end to the connector 105 on the trailer assembly 100.

Figure 6:
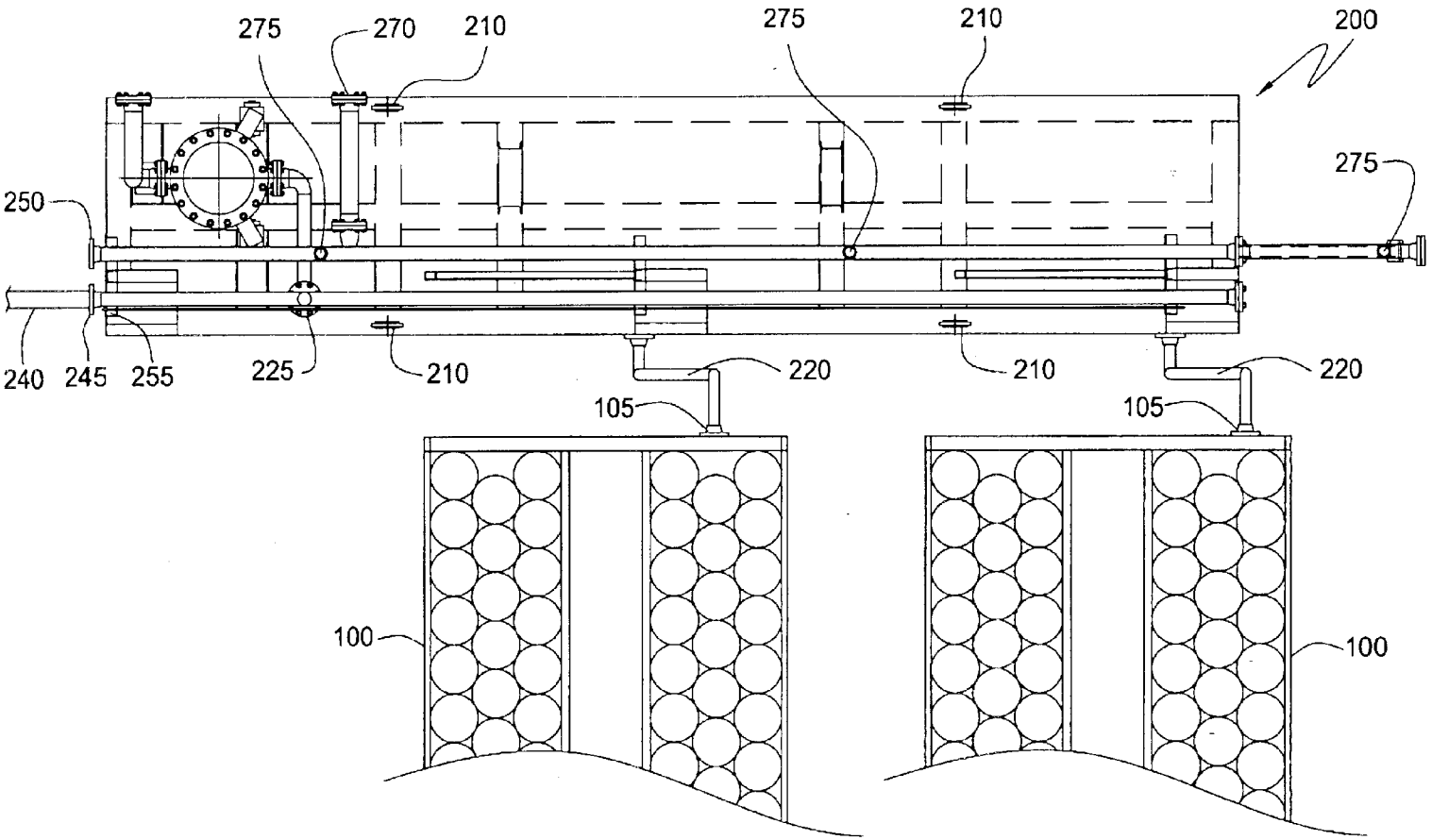
FIG. 6 illustrates unloading of acetylene from a trailer assembly through the skid-mounted apparatus.

In one embodiment shown in FIG. 6, the acetylene is unloaded from the trailer assembly 100 through the skid-mounted apparatus 200. The skid-mounted apparatus 200 may unload up to three trailer assemblies 100 simultaneously. For clarity purposes, FIG. 6 illustrates the unloading of two trailer assemblies 100. However, it should be noted in other embodiments any number of trailer assemblies 100 could be unloaded simultaneously. Generally, the arm 220 is attached to the connector 105 on the trailer assembly 100. As shown on FIG. 2, the valve 115 is used to control the amount of acetylene output from the trailer assembly 100. To start the movement of acetylene, valve 115 is opened allowing acetylene to flow from the individual cylinders 135 through the valve 140 and the pigtail 145 into the manifold 130. The manifold system 130 fluidly connects the cylinders 135 together and directs the acetylene toward the valve 115. The acetylene passes through the strainer 125 removing any contaminants from the trailer assembly 100 and subsequently exits out the connector 105 into the apparatus 200. The gauge 110 indicates the pressure of acetylene exiting the trailer assembly 100. As the acetylene flows through the various components of the apparatus 200, the pressure of the acetylene is reduced to an acceptable pressure for the point of use. The supply of acetylene exiting the trailer assembly 100 is self-regulating, wherein the need at the point of use determines the quantity of acetylene exiting the trailer assembly 100.

Referring back to FIG. 6, the low-pressure acetylene subsequently exits out the transportable gas regulating apparatus 200 through a pipe 240 that is connected to the header 245. The pipe 240 directs the low-pressure acetylene to the point of use. In the event of an acetylene fire during the unloading process, a deluge system may provide high-pressure water to quench the fire. The deluge system includes a deluge gate valve 225, a deluge riser 275, deluge header 250, and a connection flange 270 at the upper end of the apparatus 200.

Figure 7:
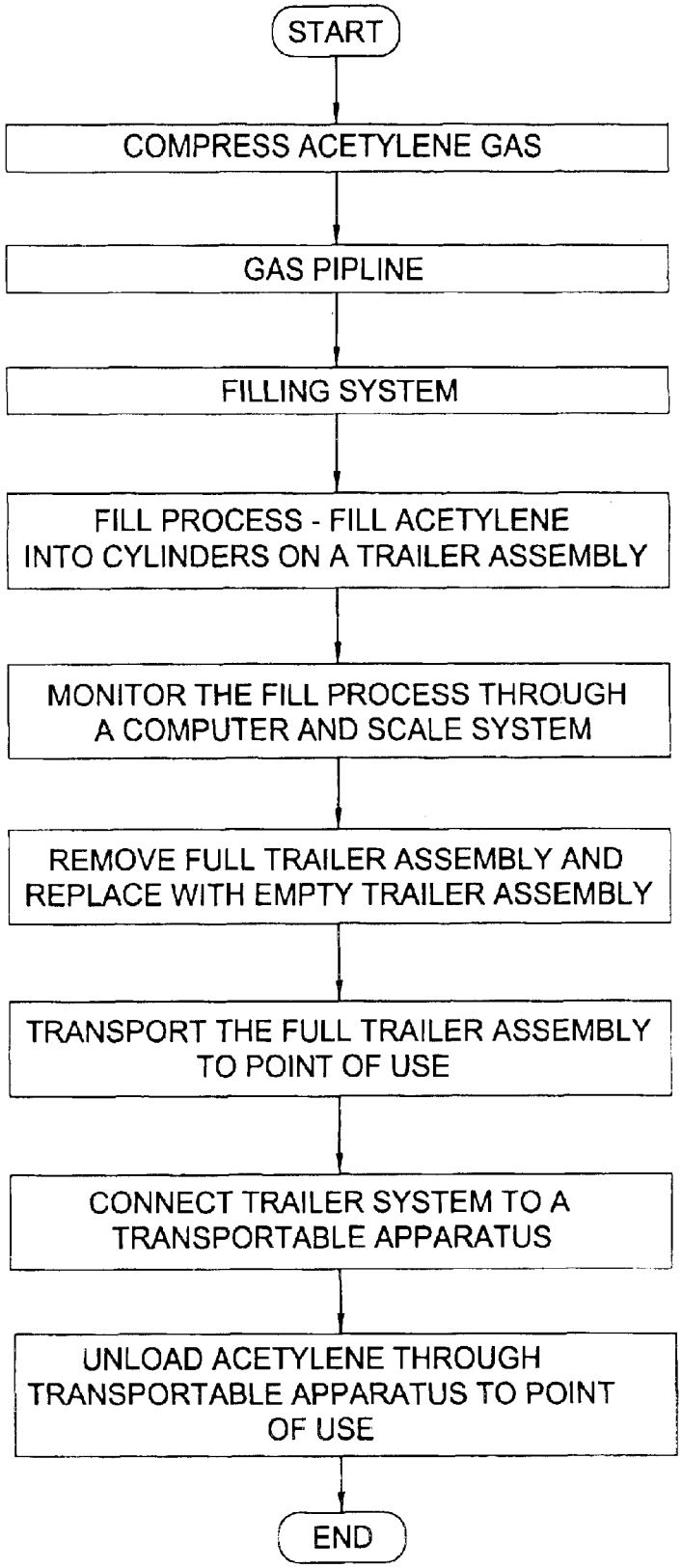
FIG. 7 illustrates the steps in the acetylene distribution system.

FIG. 7 illustrates the steps in the acetylene distribution system. As illustrated, the acetylene gas is compressed and placed in a gas pipeline. Thereafter the gas in the pipeline enters the filling system. The filling system controls the amount of acetylene gas entering each trailer assembly. During the fill process, the cylinders on the trailer assembly are filled with acetylene. The weight of the acetylene entering the cylinders is monitored through a computer and scale arrangement. The computer is configured to receive a signal from the scale when the cylinders on the trailer assembly are full of acetylene. Thereafter, the full trailer assembly is removed and replaced with an empty trailer assembly. Subsequently, the full trailer assembly is transported to the point of use. Next, the trailer assembly is connected to a transportable gas regulating apparatus. At this point, the acetylene gas in the trailer assembly is discharged through the transportable gas regulating apparatus to the point of use.

While the foregoing is directed to embodiments of the present invention, other and further embodiments of the invention may be devised without departing from the basic scope thereof, and the scope thereof is determined by the claims that follow.

What is claimed is:

1. A method for filling cylinders on a trailer system with acetylene gas, comprising:

transporting acetylene gas to a trailer fill system, the trailer filling system comprising:

a plurality of compressors;

a compressed gas supply line;

a plurality of fill bays;

a motor control center for controlling the trailer filling system; and a piping and valve arrangement that acts as a fluid conduit between the compressed supply line and the plurality of fill bays:

compressing the acetylene gas by the plurality of compressors:

moving the compressed acetylene gas through the compressed gas supply line into the piping and valve arrangement;

placing a plurality of trailer assemblies in the plurality of fill bays; and filling the cylinders on the plurality of trailer assemblies with acetylene gas.

2. The method of claim 1, whereby the piping and valve arrangement are constructed in a cascading manner to allow flow controlling to the plurality of fill bays.

3. The method of claim 2, further including forcing the compressed acetylene gas into one of the plurality of trailer assemblies that contains the greatest amount of acetylene.

4. The method of claim 3, further including diverting the flow of compressed gas to another trailer assembly as one trailer assembly becomes full, thereby permitting a constant filling flow rate of compressed acetylene gas.

5. A method for filling tanks with acetylene gas, the method comprising:

filling a first tank to a first level, wherein the first tank comprises a plurality of acetylene cylinders arranged on a first trailer;

filling a second tank and a third tank while continuing to fill the first tank, wherein the second tank comprises a plurality of acetylene cylinders arranged on a second trailer and the third tank comprises a plurality of acetylene cylinders arranged on a third trailer;

restricting the flow of gas to the second tank and the third tank while continuing to fill the first tank; and monitoring the filling of the first tank, the second tank and the third tank through a computer system and a scale.

6. The method of claim 5, whereby the first trailer, the second trailer, and the third trailer includes:

a supporting load bed frame;

at least one sidewall support member connected to the supporting load bed frame;

a plurality of support members connected to the at least one sidewall support member, whereby the plurality of support members and the at least one sidewall member are constructed to form a truss to distribute the load from the center of the trailer to the outside edge of the trailer; and a plurality of wheels mounted to the supporting load frame.

7. The method of claim 6, whereby the truss is arranged to form at least two rows and a plurality of sections to secure the cylinders in place.

8. The method of claim 7, whereby each trailer further includes a safety valve to provide an automatic shutdown during unsafe conditions.

9. The method of claim 5, further including compressing the acetylene gas.

10. A method for filling cylinders with acetylene gas, the method comprising:

supplying a constant flow of gas for filling a first plurality of cylinders and a second plurality of cylinders;

prioritizing the flow in order to direct a majority of the flow to the plurality of cylinders having the greatest amount of gas therein while maintaining the constant flow of gas;

prioritizing the flow in order to direct a majority of the flow to the other plurality of cylinders after the first plurality of cylinders reaches a predetermined amount of gas while maintaining the constant flow of gas; and monitoring the flow of gas entering into each plurality of cylinders during the filling process.

11. The method of claim 10, further including weighing the amount of gas in each plurality of cylinders.

12. The method of claim 10, further including adding a third plurality of cylinders.

13. The method of claim 12, further including prioritizing the flow in order to direct a majority of the flow to the third plurality of cylinders while maintaining the constant flow of gas.

14. The method of claim 10, further including compressing the gas.

15. The method of claim 10, whereby the first plurality of cylinders are disposed on a first trailer and the second plurality of cylinders are disposed on a second trailer.

* * * * *